US006322387B2

(12) United States Patent
Kawamae et al.

(10) Patent No.: US 6,322,387 B2
(45) Date of Patent: Nov. 27, 2001

(54) LATCHING CONNECTOR ASSEMBLY

(75) Inventors: Takahiro Kawamae, Kawasaki; Shuji Kajinuma, Yamato, both of (JP)

(73) Assignee: Tyco Electronics. AMP, K.K., Kanagawa (JP)

( * ) Notice: Subject to any disclaimer, the term of this patent is extended or adjusted under 35 U.S.C. 154(b) by 0 days.

(21) Appl. No.: 09/736,830

(22) Filed: Dec. 14, 2000

(30) Foreign Application Priority Data

Dec. 21, 1999 (JP) ..... 11-363080

(51) Int. Cl.[7] ..... H01R 13/62
(52) U.S. Cl. ..... 439/358
(58) Field of Search ..... 439/357, 358, 439/353, 607, 609, 610

(56) References Cited

U.S. PATENT DOCUMENTS

| | | | | |
|---|---|---|---|---|
| 5,213,533 | * | 5/1993 | Walden | 439/372 |
| 5,380,223 | * | 1/1995 | Marsh et al. | 439/610 |
| 5,741,150 | * | 4/1998 | Stinson et al. | 439/358 |
| 5,788,528 | * | 8/1998 | Orr, Jr. et al. | 439/358 |
| 6,056,578 | * | 5/2000 | Lin | 439/358 |
| 6,146,205 | * | 11/2000 | Lai | 439/610 |
| 6,149,451 | * | 11/2000 | Weber | 439/358 |
| 6,210,202 | * | 4/2001 | Kuo | 439/358 |
| 6,217,364 | * | 4/2001 | Miskin et al. | 439/358 |

FOREIGN PATENT DOCUMENTS

| | | |
|---|---|---|
| 1-140780 | 6/1989 | (JP) . |
| 10-154550 | 6/1998 | (JP) . |
| 11-162566 | 6/1999 | (JP) . |

* cited by examiner

*Primary Examiner*—Brian Sircus
*Assistant Examiner*—Thanh-Tam Le

(57) ABSTRACT

The present invention provides a plug 2 and receptacle 100 each having shells 6,104. When the connectors 2,100 are engaged, the shell 104 of the receptacle 100 slides in contact with the shell 6 of the plug 2. The steps 152 of the shell 104 are positioned beneath the steps 14 of the shell 6, so that openings 118 and 34 formed in the respective steps 152 and 14 are aligned with each other when the connectors are completely engaged with each other. During the process of engagement, the claws 32 of the latching arms 10 move along the steps 152, advance into the openings 118 by the action of the plate springs 47, to latch the plug and receptacle together. To disengage, the release sections of the latching arms 10 are pressed whereupon the engaging members 30 open so that the claws 32 exit the openings 118.

12 Claims, 11 Drawing Sheets

(A)

(B)

(C)

PRIOR ART

LATCHING CONNECTOR ASSEMBLY

FIELD OF THE INVENTION

The present invention relates to an electrical connector assembly, and more specifically relates to an electrical connector assembly which consists of a first connector that has latching arms, and another board-mounted connector that is secured to the first connector by a latching mechanism.

BACKGROUND

Conventionally, board-mounted electrical connectors have been attached to the surfaces of printed circuit boards on which other electronic or electrical components are mounted. Accordingly, a reduction in size that allows the efficient mounting of numerous components has been required in such electrical connectors. Such component size reduction is also required for connectors that engage with these board-mounted connectors.

The board-mounted electrical connector disclosed in Japanese Utility Model Application Kokai No. H1-140780 is one such connector. This connector is designed so that the end portions of a pair of locking levers disposed on the outside of a shell engaging member are caused to open to the left and right by pressing the locking levers. Disengagement from the mating connector is accomplished by operation of the locking levers.

Similar electrical connectors are disclosed in Japanese Patent Application Kokai No. H10-154550 and Japanese Patent Application Kokai No. H11-162566. The connector disclosed in Japanese Patent Application Kokai No. H10-154550 is shown in FIG. 12. In this plug 200, a resilient locking member 204 which has a hook 214 used for engagement on its end, is disposed on the side surface of the housing main body 202. A projection 208 is formed on a resilient arm 206 of this locking member 204. A release button 210 having a release section 212 that has an inclined surface 209 for engaging the projection 208 protrudes toward the outside of the locking member. When the release button 210 is pressed, the release section 212 presses the projection 208 down, so that the hook 214 on the end of the locking member 204 is pressed down, thus causing the plug 200 to be released from it's mating connector.

In the conventional electrical connector disclosed in Japanese Utility Model Application Kokai No. H1-140780, locking levers and locking lever engaging members are disposed on the outside of both ends of the shell engaging member. Accordingly, it is difficult to reduce the width of the connector. Furthermore, in the case of Japanese Patent Application Kokai No. H10-154550 illustrated in FIG. 12, it is necessary to release the engagement by converting the operation of the release button 210 in the horizontal direction into movement of the hook 214 in the vertical direction. As a result, although the amount of movement of the locking member 204 in the left-right direction is small, the length of the inclined surface 209 is increased if an attempt it made to reduce the required operating force of the release button 210. Consequently, the amount of movement of the release button 210 must be increased, and it may therefore be difficult to reduce the dimension of the connector in the direction of width. Furthermore, since the hook 214 of the locking member 204 moves upward and downward, there may be cases in which it is difficult to reduce the dimension of the connector in the vertical direction, depending on the amount of this movement. Moreover, the engaging member 216 of the plug 200 has a rectangular shape, so that there is a danger of backward attachment to the mating connector.

SUMMARY

The present invention was devised in light of the above-mentioned problems. An object of the present invention is to provide a compact electrical connector assembly which has a small size both in the width and height dimensions. Furthermore, another object of the present invention is to provide an electrical connector assembly which prevents backward insertion of the connectors.

The invention therefore provides an electrical connector system having a plug and receptacle, each of the plug and receptacle have a shell disposed inside a housing. A latch arm is disposed substantially outside the plug shell. The latch arm has an engaging member extending through a first opening into the inside of the plug shell. A second opening is formed in the receptacle shell along a step. The second opening receives and latches with the engaging member when the plug and receptacle are mated.

BRIEF DESCRIPTION OF THE DRAWINGS

The invention will now be described by way of example with reference to the accompanying figures of which:

FIG. 4(A) shows a plan view, FIG. 4(B) shows a front view, and FIG. 4(C) shows a side view of the shell as seen from the direction indicated by arrow C.

FIG. 5(A) is a plan view, FIG. 5(B) is a side view, and FIG. 5(C) is an enlarged front view.

FIG. 7(A) is a plan view, FIG. 7(B) is a front view, and FIG. 7(C) is a side view.

FIG. 9(A) is a plan view, FIG. 9(B) is a front view, and FIG. 9(C) is a side view.

FIG. 10(A) is a plan view, FIG. 10(B) is a front view, and FIG. 10(C) is a side view

DETAILED DESCRIPTION OF THE PREFERRED EMBODIMENT

Figure 1:
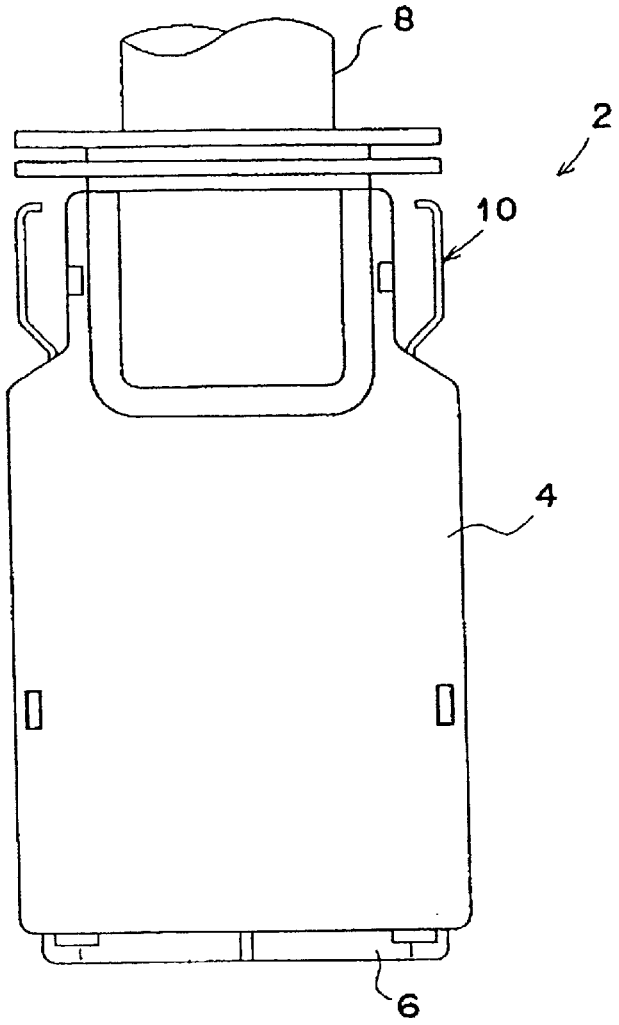
FIG. 1 is a plan view of the plug used in the electrical connector assembly of the present invention.
Figure 2:
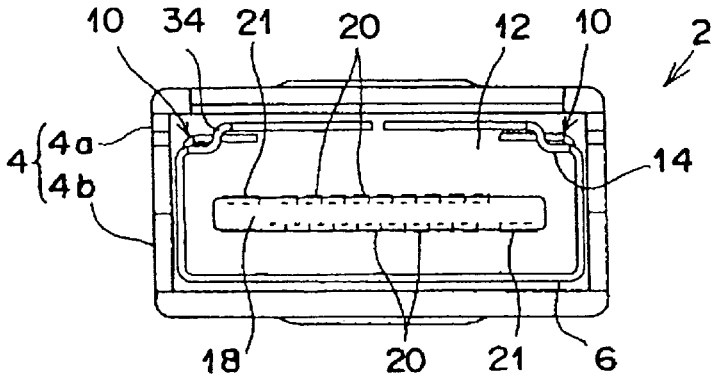
FIG. 2 is a front view of the electrical connector shown in FIG. 1.

An embodiment of the invention will be described with reference to FIGS. 1 through 3. The plug 2 is attached to the end portion of a cable 8. As shown in FIGS. 1 and 2, this plug 2 has a cover 4 consisting of a set of cover halves 4*a* and 4*b* that are preferable made of a resin or other suitable insulative material. Narrow portions are provided at the rear end of the housing near the cable 8, a shielding shell 6 and latching arms 10 are disposed inside the cover 4.

As is shown in FIG. 2, the shell 6 is disposed inside a rectangular recess 12 formed by the cover 4. Steps 14 are formed on both sides of the upper portion of the shell 6, and respective openings 34 are formed within these steps 14. Furthermore, in the approximate center of the recess 12, a rib or platform 18 made of insulative material extends through the recess 12. A plurality of contacts 20 is disposed along both the upper and lower sides of the rib 18. The contacts 20 on the upper side and the contacts 20 on the lower side are disposed in positions that are shifted or staggered relative to each other. Power supply contacts 21 are disposed at both ends of the rows of contacts 20. One set of these power contacts 21 is disposed on the upper surface of the platform 18 and the other is disposed on the lower surface. These power supply contacts 21 are positioned distant from each other to allow even heat dissipation through the platform 18.

Figure 3:
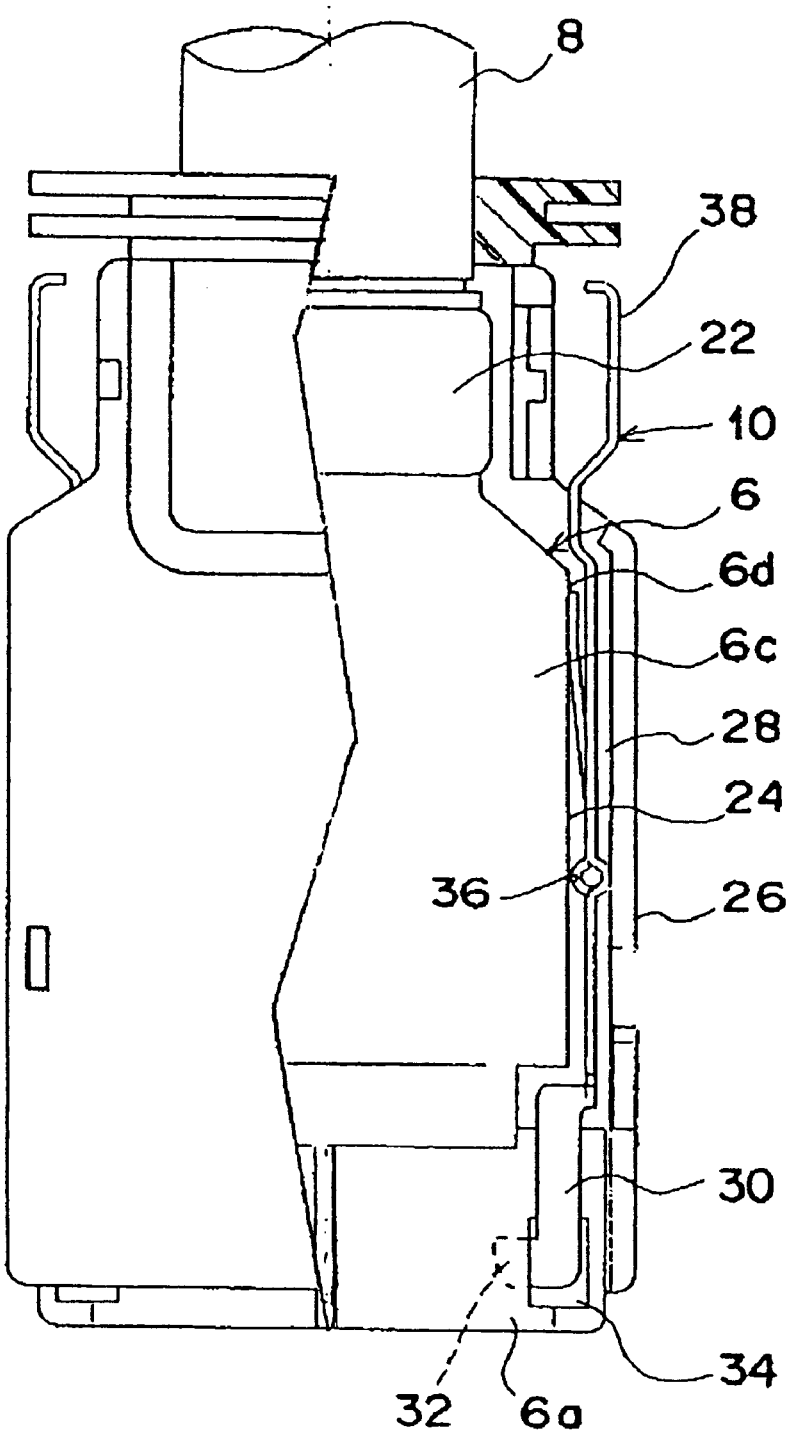
FIG. 3 is a plan view similar to FIG. 1, which shows a partially sectional view of the connector shown in FIG. 1.

Next, as is shown in FIG. 3, the rear portion of the shell 6 is relatively narrow to conform with the shape of the cover 4. A metal ferrule 22 is crimped over the cable 8 and shell 6. Spaces 28 are formed between the side walls 24 of the shell 6 and the side walls 26 of the cover 4. Latching arms 10 are disposed inside these spaces 28. It should be understood that while only one latching arm 10 is shown in the cut away portion of FIG. 2, another latching arm 10 is similarly situated on the opposite of the plug 2. Pivots 36 are formed roughly in the center of each latching arm 10. These pivots 36 have generally circular openings for receiving a pivot pin formed in the cover 4. When release sections 38 are pressed, the latching arms 10 pivot about these pivots 36 so that the engaging members 30 move away from each other to open. The engaging members 30 of the latching arms 10 have claws 32. These claws 32 are constructed so that they advance into or slip out of openings 34 formed in the shell 6.

Figure 4:
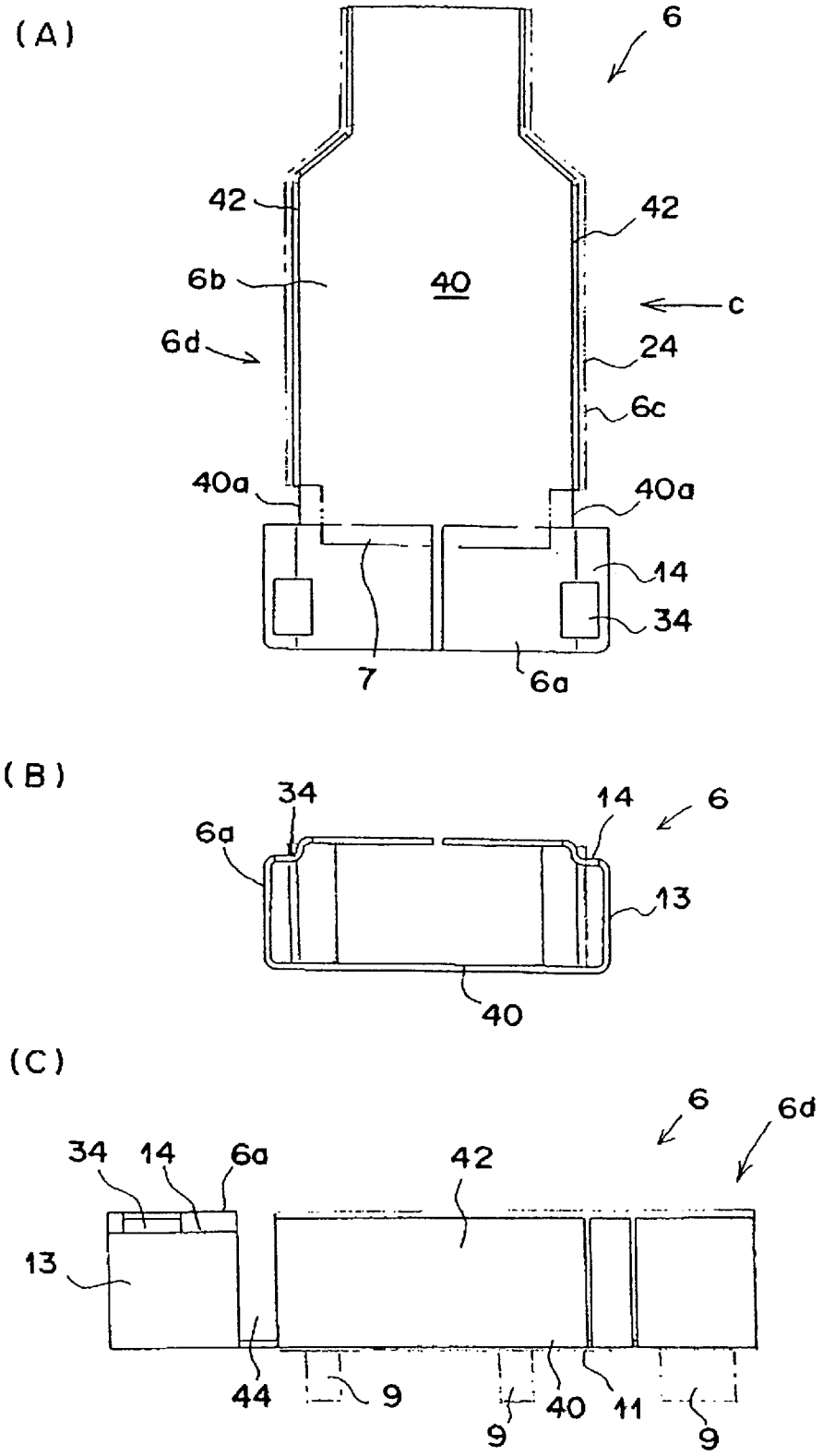
FIG. 4 shows the shell of the electrical connector shown in FIG. 1.

The shell 6 will now be described in greater detail with reference to FIGS. 4(A–C). The shell 6 is conductive and is formed of upper and lower shell halves 6*d*, 6*b*. The upper shell half 6*d* is shown in phantom in FIGS. 4(A and C). The lower shell half 6*b* has a base 40 from which is formed a closed front section 6*a* best shown in FIGS. 4(A and B). Walls 42 extend vertically from both sides of the base 40 except in the area of the closed front section 6*a* to form the rear portion of the lower shell half 6*b*. The upper shell half 6*c* has substantially the same shape as the lower shell half 6*b* and fits over the lower shell half 6*b*. A plurality of claws 9 extends from the lower edges 11 of the upper shell half 6*d* as shown in FIG. 4(C). These claws 9 are bent over the outside of the base 40 of the lower shell half 6*b* to secure the shell halves 6*d*, 6*b* together. A rectangular extension 7 protrudes forward form the upper shell half 6*d* and is bent toward the closed front section 6*a*. This rectangular extension 7 is engaged with and urges the closed front section 6*a* closed to provide greater normal force against the mating connector inserted into the closed front section 6*a*. Steps 14 extending on both sides of the upper portion of the closed front section 6*a* form rectangular openings 34. A gap 44 is formed behind the closed front section 6*a* as shown in FIG. 4(C).

Figure 5:
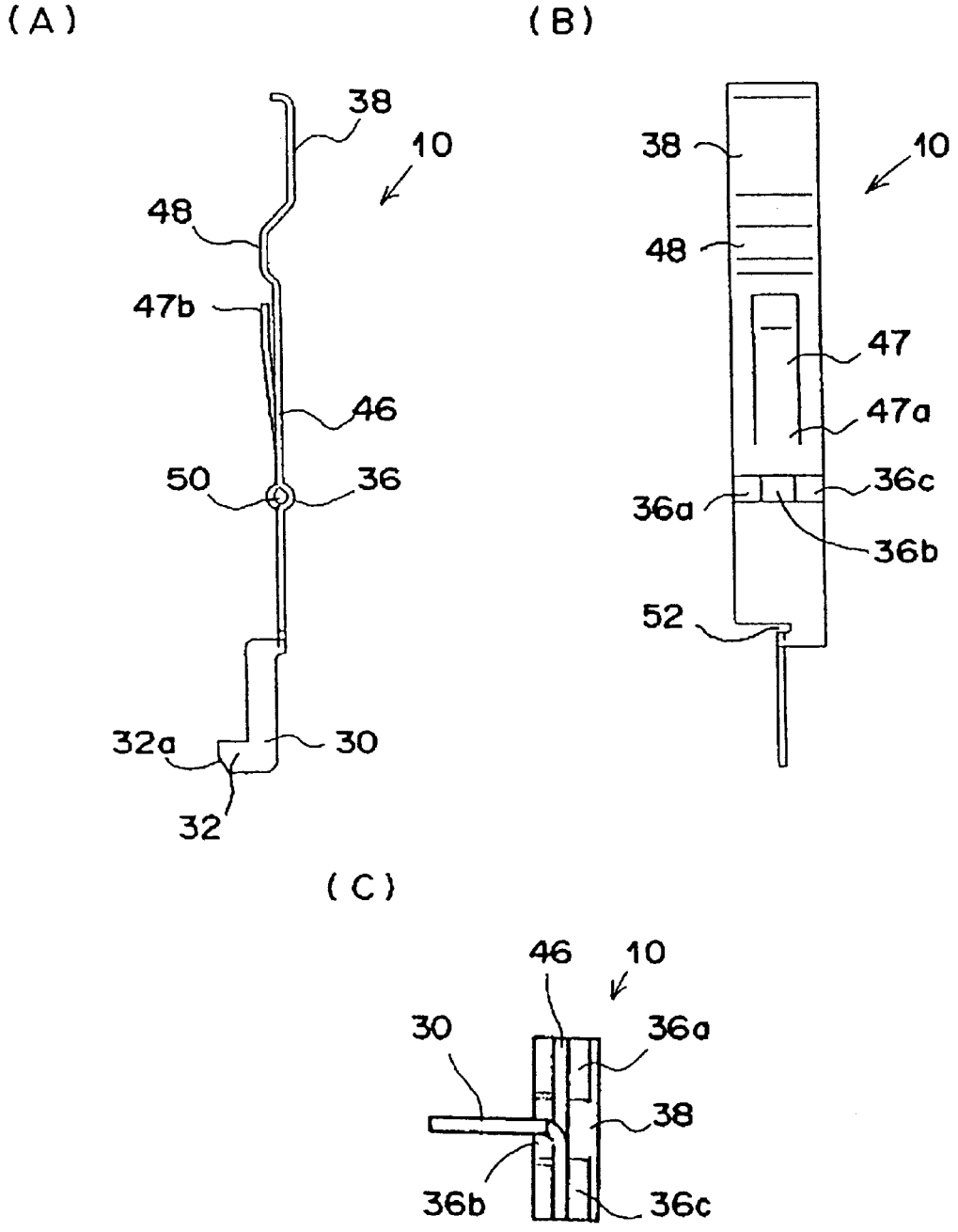
FIG. 5 shows [one of] the latching arms of the electrical connector shown in FIG. 1.

Each latching arm 10 will now be described in greater detail with reference to FIGS. 5(A–C). The latching arm 10 is formed of a conductive sheet material. A release section 38 is formed on the rear portion of the main body 46 with an indentation 48 positioned between the main body 46 and release section 38. A slot 52 is formed in the front end of the main body 46. An engaging member 30 is bent from the slot 52 to be substantially perpendicular to the main body 46. A claw 32 is formed on the end of the engaging member 30. A taper 32*a* is positioned on the end of the claw so that this claw will ride up over the shell of the mating connector when the connectors are engaged with each other. A pivot 36 is formed substantially in the center of the main body 46. This pivot 36 is punched out from main body 46 as is shown most clearly in FIG. 5(B). Here it can be seen that opposing arcuate portions 36*a*, 36*b* and 36*c* are punched from opposite sides of the main body 46 such that their centers are in alignment forming a through hole 50 for receiving a pivot pin. A spring 47 which is punched out on the same side as the engaging member 30 extends from the main body 46 between the pivot 36 and the indentation 48. The fixed end 47*a* of the spring 47 is positioned near the pivot 36 while the free end 47*b* extends so that it contacts the wall 24 of the shell 6 as shown in FIG. 3. As a result, when the latching arm 10 is attached, the release section 38 is constantly driven toward the outside by the spring 47.

Figure 6:
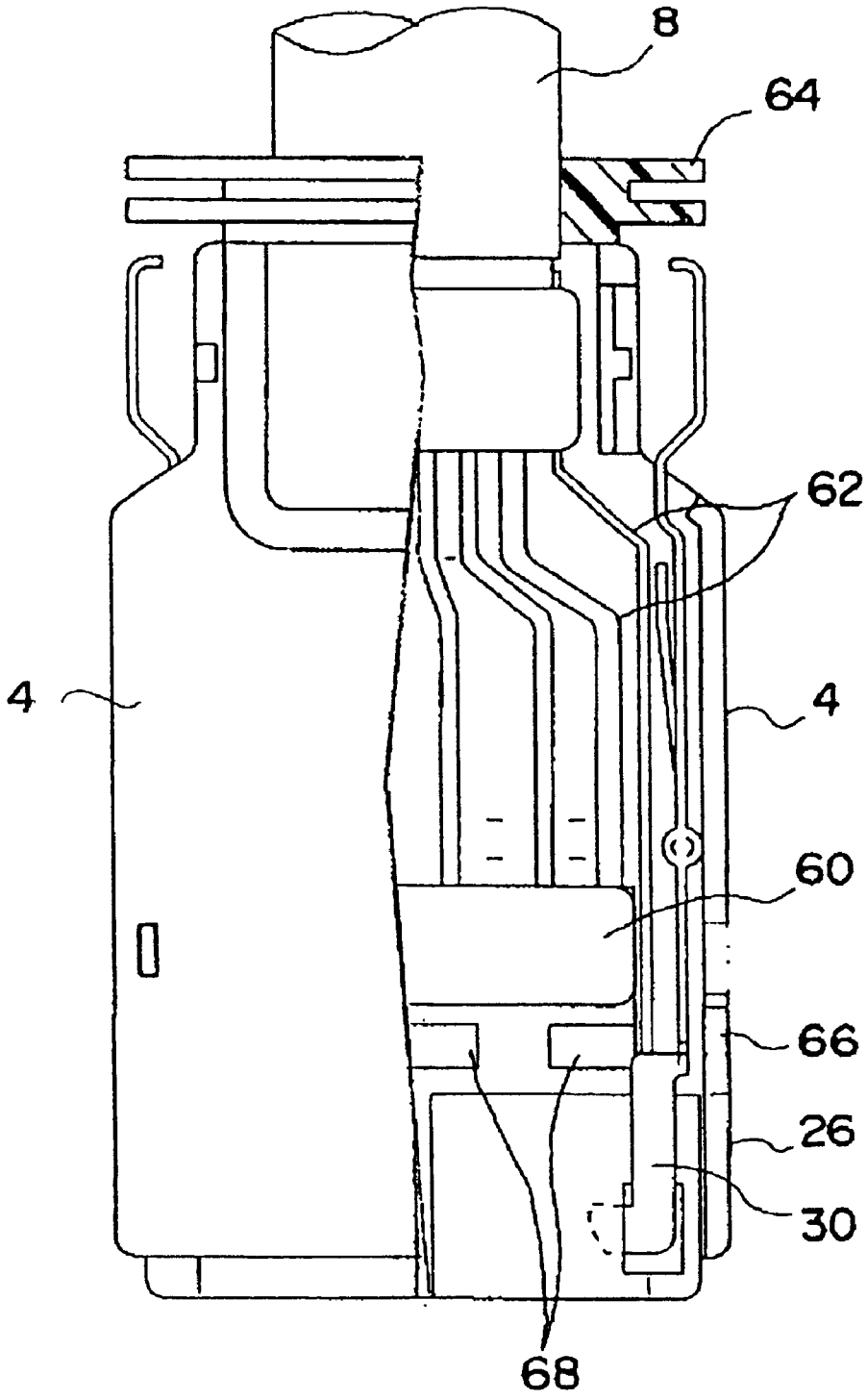
FIG. 6 shows a plan view similar to FIG. 3, in which the upper shell half has been removed.

FIG. 6 shows a plan view similar to FIG. 3, in which the upper shell half 6*c* has been removed. In FIG. 6, 60 indicates an inner housing that covers the portions of the contacts 20. A grommet 64 is integrally formed with the cover 4 and surrounds the cable 8 to provide anti-overstress protection when the cable 8 is bent. Openings 66 are formed near the front of the side walls 26 of the cover 4 to receive the engaging members 30 of the latching arms 10 when they are urged outward. Rectangular recesses 68 are formed in the shell 6 and engage complementary projections (not shown in the figures) on the cover 4 so that the shell 6 and cover 4 are properly positioned. It is preferable that these parts be formed without cutting so that there is no loss of the shielding effect.

Figure 7:
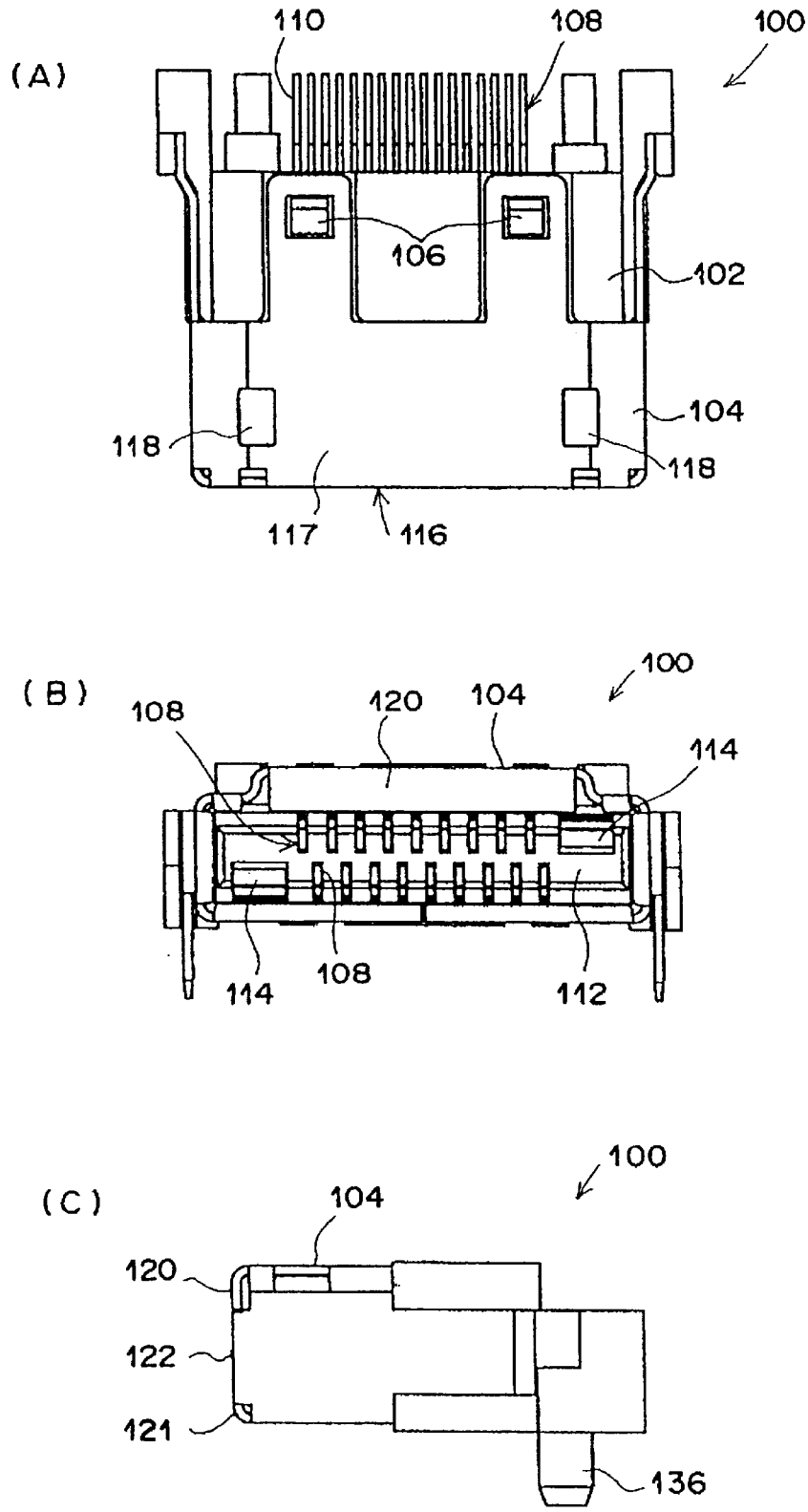
FIG. 7 shows a receptacle that constitutes the other electrical connector used in the connector assembly of the present invention.

FIGS. 7(A–C) show a board mounted receptacle receptacle 100 that is matable with the plug 2. The receptacle 100 has a substantially rectangular shape and has a metal shell 104 disposed over a housing 102 and assembled from the front end of the housing 102. The shell 104 is anchored by engaging projections 106 formed in several places on the housing 102. Rectangular openings engaged parts 118 are formed on both sides in the upper surface 117 of the shell 104 near the front end. When the connectors 2, 100 are engaged with each other, the claws 32 of the latching arms 10 advance into and engage these openings 118 so that the connectors are latched to each other. The tines 110 of the contacts 108 mounted in the housing 102 protrude from the rear part of the housing 102.

As is shown most clearly in FIG. 7(B), a plurality of contacts 108 are disposed in two rows inside a rectangular recess 112 that opens to the front surface of the housing 102. In order to achieve better signal isolation, the contacts of the upper row and contacts of the lower row are disposed in positions that are shifted or staggered relative to each other. In FIG. 7(B), a power supply contact 114 is disposed at the right end of the upper contact row, and another similar power supply contact 114 is disposed at the left end of the lower contact row. These power supply contacts 114 are positioned on a diagonal line that results in a maximum distance and improved heat dissipation between the two contacts inside the recess 112. When the shell 104 is attached to the housing 102, the shell 104 substantially covers the side surfaces of the housing 102, and the front surfaces 120 and 121 of the shell 104 are substantially coplanar with the engaging surface 122 of the housing 102.

Figure 8:
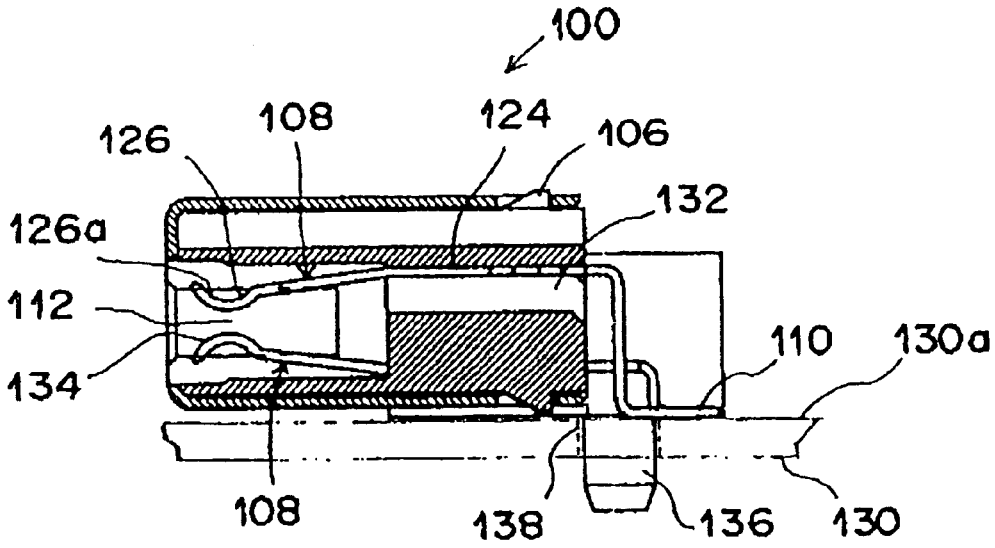
FIG. 8 shows a longitudinal sectional view of the electrical connector in FIG. 7 that cuts across the area of the upper contacts.

Turning now to the sectional view of FIG. 8, each contact 108 is formed to have a main body 124, a contact portion 126 that extends forward and toward the inside of the recess 112 from the main body 124, and a tine 110 which extends to the rear toward the printed board 130 from the main body 124. An appropriate number of barbs are formed on both side edges of the main body 124 of each contact 108 for engaging the inside walls of the contact receiving cavities 132 of the housing 102. Indentations 134 that protrude toward the contacts 108 in the other row are formed on the end portions 126*a* of the contact portions 126. When the connectors are engaged with each other, the contacts 20 of the plug side plug 2 are disposed between these contact portions 126, so that the respective facing contacts make electrical contact with each other. When the receptacle 100 is fastened to the printed board 130, the tines 110 are soldered to conductive pads (not shown in the figures) on the printed board 130. Furthermore, the legs 136 on the rear part of the shell 104 are inserted into corresponding through-holes 138 in the printed board, and are connected to ground.

Figure 9:
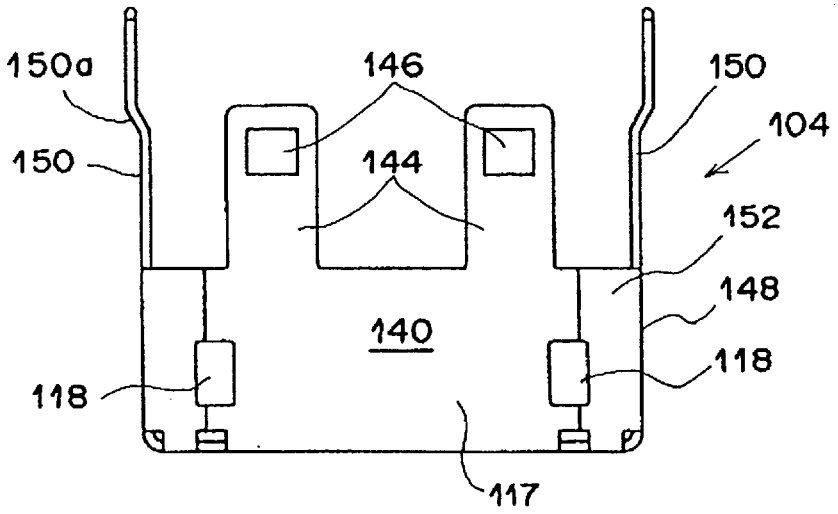
FIG. 9 shows the shell of the receptacle in FIG. 7.
Figure 9:
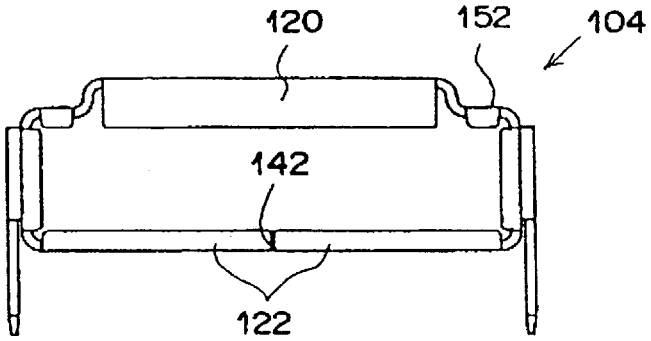
Figure 9:
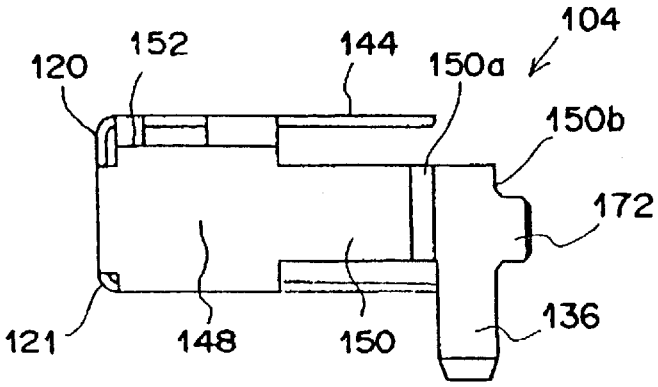

Referring now to FIGS. 9(A–C) the shell 104 has a main body 140 formed into a substantially rectangular shape so that the edges 142 abut each other on the lower side as best shown in FIG. 9(B). Two tongues 144 extend rearward from the upper surface 117 of the main body 140. Rectangular openings 146 are formed in the ends of these tongues 144 and these openings are engaged with the engaging projections 106 of the housing 102 (FIG. 7 (A), FIG. 8). Extensions 150 extend rearward from the side surfaces 148 of the main body 140. These extensions 150 widen slightly at transition sections 150*a*. Rectangular protruding ears 172 extend from the ends 150*b* of the extensions 150, and legs 136 drop downward from the lower portions of these ends. It should be noted here that the upper surface 117 is formed in two stages having steps 152 on both sides, and that the openings 118 are formed so that they extend from the upper surface 117 to the vicinities of the steps 152. As a result, the claws 32 of the plug 2 can be accommodated.

Figure 10:
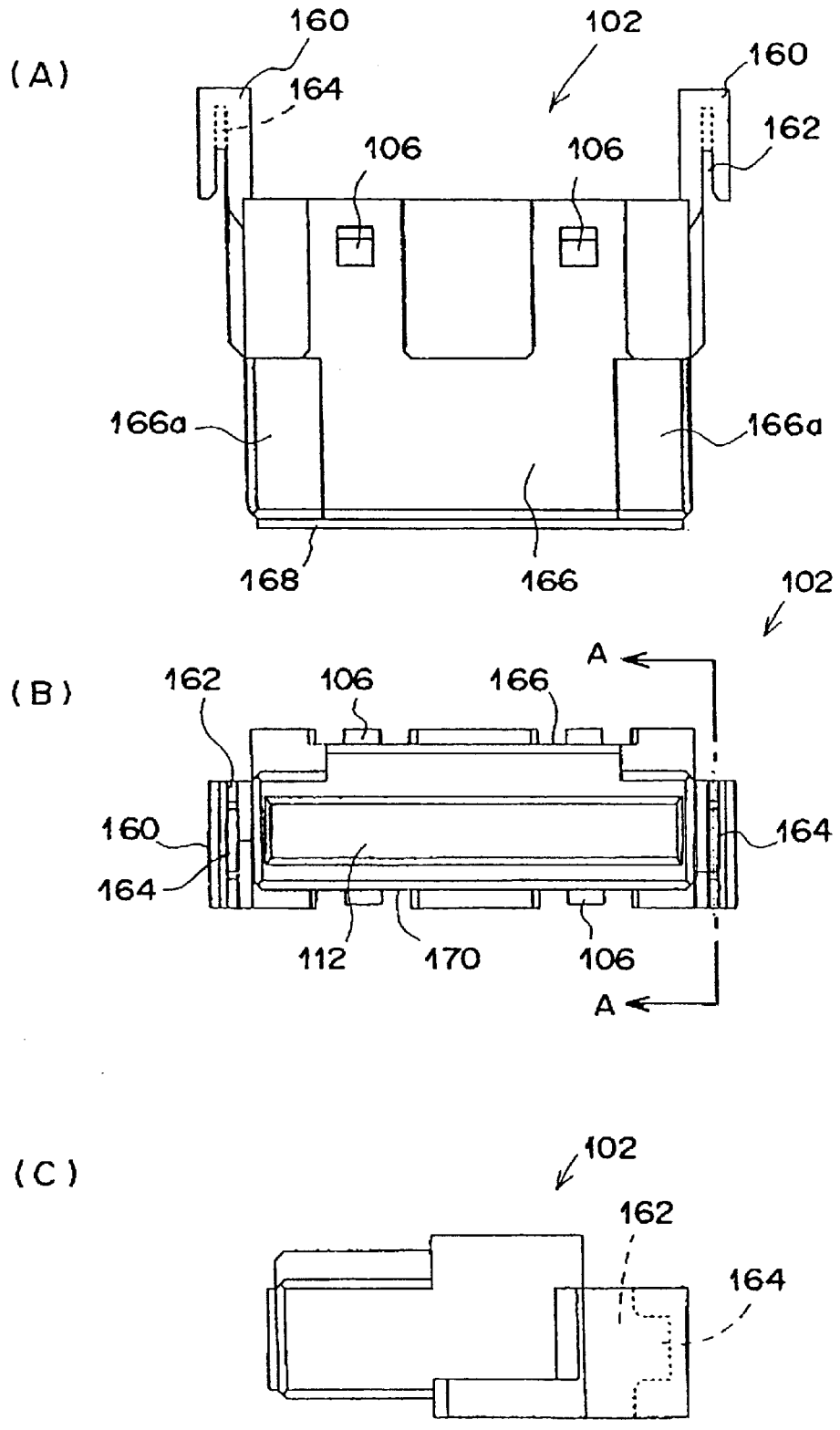
FIG. 10 shows the housing of the receptacle.

Next, the housing 102 is shown in FIG. 10. Attachment parts 160 are formed on both sides of the rear part of the housing 102. Slots 162 that extend rearward from the front are formed in these attachment parts 160 and stopping grooves 164 that extend even more deeply inward are formed within these slots 162. Steps 166*a* that extend from the front surface 168 are formed on both sides of the front part of the upper surface 166 of the housing 102. Furthermore, the engaging projections 106 are formed so that they protrude in four places on the upper and lower surfaces 166 and 170. When the shell 104 is fit over the housing 102, the end portions of the extensions 150 of the shell 104 advance into the slots 162 of the attachment parts 160 of the housing 102, so that the protruding ears 172 of the shell 104 are seated in the stopping grooves 164. Furthermore, the steps 152 of the shell 104 are positioned on the steps 166*a* of the housing 102, and the openings 146 in the shell 104 engage with the engaging projections 106.

Figure 11:
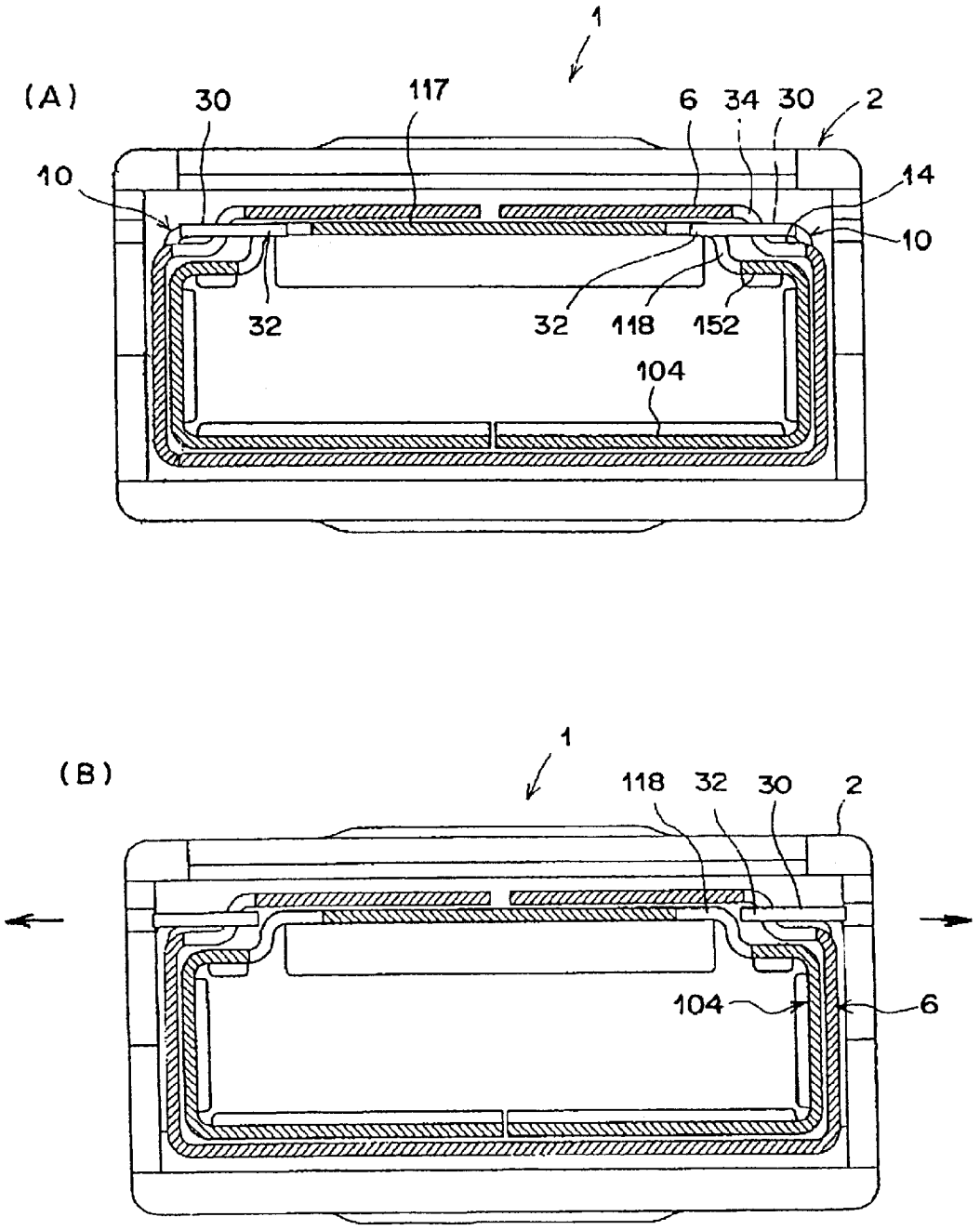
FIG. 11 shows sectional views that illustrate (in a simplified form) the engagement relationship when the connectors are engaged with each other.
Figure 12:
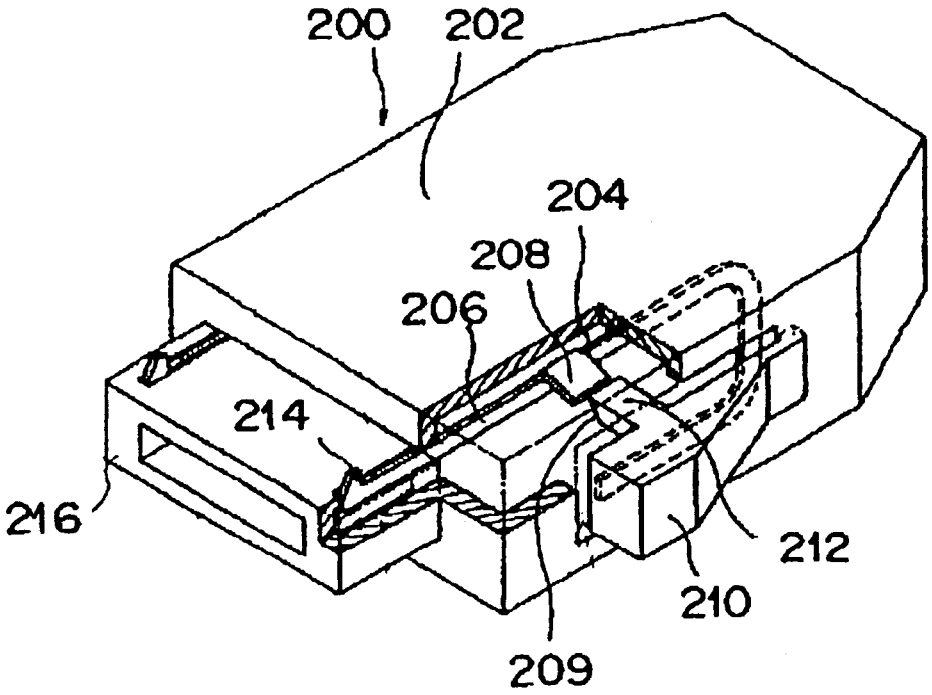
FIG. 12 is a perspective view illustrating a conventional prior art electrical connector.

FIG. 11 shows sectional views that illustrate the engagement relationship between the shells 6 and 104 when the connectors are engaged with each other. FIG. 11(A) is a sectional view showing a state in which the latching arms 10 of the plug 2 are engaged with the shell 104 of the receptacle 100. FIG. 11(B) is a sectional view showing a state in which the latching arms 10 have been released. The steps 152 of the shell 104 are positioned beneath the steps 14 of the shell 6, so that openings 118 and 34 formed in the respective steps 152 and 14 are aligned with each other when the connectors are completely engaged. During the process of engagement, the claws 32 of the latching arms 10 move along both sides of the upper surface 117 of the shell 104. When these claws 32 reach the openings 118, they advance into the openings 118 by the action of the springs 47 until the claws 32 engage as shown in FIG. 11(A).

In order to release the connectors 2, 100, the release sections 38 of the latching arms 10 are pressed inward whereupon the engaging members 30 open so that the claws 32 are removed from the openings 118. As a result, the engagement of the two connectors 2 and 100 is released.

The present invention was described in detail above with reference to a preferred embodiment. However, this embodiment was only an example and the present invention is not limited to such embodiment. For example, it will be readily apparent to a person skilled in the art that the shapes of the shells and the shape of the latching arms or pins can be varied in accordance with the shapes of the connectors without departing from the spirit of the present invention.

An advantage of the electrical connector assembly of the present invention is that the engaging members of the latching arms are flat parts which move in a plane along the direction of length of the thus limiting movement of the claws in the direction of height of the connector. This reduces the height dimension. The width dimension of the connector is also reduced by the fact that latching arms have a relatively small claw and have a relatively small width dimension.

An additional advantage is that both shells are made symmetrical to each other to prevent improper plug insertion.

What is claimed is:

1. An electrical connector system having a plug and receptacle, each of the plug and receptacle having a shell disposed inside a housing, the connector system comprising:

a latch arm disposed substantially outside the plug shell, the latch arm having an engaging member extending through a first opening into the inside of the plug shell;

a second opening formed in the receptacle shell along a step, the second opening receiving and latching with the engaging member when the plug and receptacle are mated.

2. The electrical connector system of claim 1 wherein the plug shell is closed by upper and lower halves.

3. The electrical connector system of claim 2 wherein the lower half of the plug shell comprises a base and a pair of side walls extending from the base.

4. The electrical connector system of claim 3 wherein the plug shell further comprises a closed front section extending from the base.

5. The electrical connector system of claim 4 wherein a step is formed in the closed front section and the second opening is disposed on the step.

6. The electrical connector system of claim 5 wherein the second opening extends through two substantially perpendicular portions of the closed front section step.

7. The electrical connector system of claim 5 wherein the plug shell further comprises an extension extending from the base to engage the closed front section.

8. The electrical connector system of claim 1 wherein the second opening extends through two substantially perpendicular portions of the step.

9. The electrical connector system of claim 1 wherein the latch arm is pivotally connected to the housing such that an inward force applied to a rear end causes outward motion of the engaging member.

10. The electrical connector system of claim 9 wherein the receptacle shell enters into the plug shell during mating.

11. The electrical connector system of claim 10 wherein the first and second openings are in alignment in a mated position.

12. The electrical connector system of claim 11 wherein the engaging member of the latch arm pivots into the aligned openings to latch the plug and receptacle together.

* * * * *